United States Patent [19]

Vandervalk

[11] 4,448,872

[45] May 15, 1984

[54] DUPLEX IMAGING WITH PRESSURE TRANSFIXING

[75] Inventor: Casey S. Vandervalk, Mendon, Mass.

[73] Assignee: Delphax Systems, Mississauga, Canada

[21] Appl. No.: 426,335

[22] Filed: Sep. 29, 1982

Related U.S. Application Data

[63] Continuation-in-part of Ser. No. 14,196, Feb. 22, 1979, abandoned.

[51] Int. Cl.[3] ..... G03G 13/14

[52] U.S. Cl. ..... 430/126; 430/98; 355/24

[58] Field of Search ..... 427/24; 355/23, 24, 355/26; 430/98, 126

[56] References Cited

U.S. PATENT DOCUMENTS

| | | | |
|---|---|---|---|
| 3,591,276 | 7/1971 | Byrne | 430/98 |
| 3,669,706 | 6/1972 | Sanders et al. | 430/126 |
| 3,697,171 | 10/1972 | Sullivan | 430/126 |
| 3,854,975 | 12/1974 | Brenneman et al. | 430/98 |
| 3,932,035 | 1/1976 | Sato et al. | 430/126 |

*Primary Examiner*—John E. Kittle
*Assistant Examiner*—John L. Goodrow
*Attorney, Agent, or Firm*—Arthur B. Moore

[57] ABSTRACT

Method and apparatus for duplex electrostatic imaging wherein a toner image is transferred and simultaneously fixed to two sides of a receptor medium using high pressure. The first toner image is created on a dielectric image roller and pressure transferred to a transfer roller moving at an identical surface velocity. A second toner image is subsequently formed on the image roller, and the two images are simultaneously transferred and fused to opposite sides of a receptor sheet at the nip. The image roller advantageously includes a hard, very smooth dielectric surface, while the transfer roller has a moderately smooth, compliant surface. The transfer roller surface preferably comprises an engineering thermoplastic or thermoset material characterized by a relatively low coefficient of friction in order to provide high transfer efficiency to the receptor sheet. The duplex imaging apparatus may be incorporated into electrostatic printers and copiers with suitable adaptations in the image generating stages.

18 Claims, 13 Drawing Figures

10

DUPLEX IMAGING WITH PRESSURE TRANSFIXING

This application is a continuation-in-part of U.S. Ser. No. 014,196, filed Feb. 22, 1979, now abandoned.

BACKGROUND OF THE INVENTION

The present invention relates to electrographic printing and copying, and more particularly to a novel method and apparatus for duplex electrographic imaging.

In the broad arts of electrographic printing and copying considerable effort has been expended in designing systems for transferring toner images to both sides of a receptor medium. This is commonly known as "duplex imaging". Prior art processes include sequential duplex imaging, wherein toner images are formed on opposite sides of the receptor sheet in sequence, and simultaneous duplex imaging, wherein the two images are simultaneously transferred. The need for duplex printing and copying has long been recognized but has encountered various handicaps to effective implementation.

The various techniques for duplex imaging may be classified according to the method employed to transfer the toner image to the ultimate receptor, and perhaps as to intermediate transfers. Typical techniques include electrostatically aided transfers, transfers requiring heating the toner image, transfers using solvent vapors, and transfers requiring high pressure. Where a process as conventionally performed utilizes heat or a solvent vapor to cause the toner image to become soft and tackified, this poses a problem of offsetting and smudging in duplex imaging, particularly where both sides of the sheet are subjected to heat or vapor simultaneously. Alternatively, when sequential transfer has been employed, long time delays have been required to assure complete fusing of the first image prior to transfer of the second. It is well known in addition that heat fusing causes wrinkling and drying of the paper.

U.S. Pat. No. 3,318,212 discloses transfer imaging systems involving a plurality of support structures, using solvent vapors to tackify the toner image. In this system, the toner images are simultaneously transferred to opposite sides of the receptor sheet. This does not avoid the inherent liabilities of solvent vapor toner transfer systems, such as the loss of solvent vapors by evaporation, and the danger of flammable or toxic vapors. The presence of such vapors imposes various demands in machine design which considerably complicate such devices.

U.S. Pat. No. 3,697,171 discloses a simultaneous image transfer system wherein a toner image is formed on a first roller, electrostatically transferring to an intermediate roller, a second image then formed on the first roller, followed by simultaneous electrostatic transfer of two images to a receptor medium passed between these two rollers. Again, this system requires postfusing, and suffers the limitations inherent in electrostatic toner transfer, such as image density losses due to toner transfer inefficiencies.

Accordingly, it is a primary object of the invention to provide a reliable duplex electrographic imaging technique. In particular, this technique should provide a simultaneous transfer and fusing of the toner image.

Another object of the invention is to design duplex imaging apparatus providing high quality transfer and fusing of toner images. As a related object, both images shall be well defined, with little or no smudging or mottling. A further related object is that such images be permanently bonded to the carrier, without need for postfusing.

SUMMARY OF THE INVENTION

In furthering the above and related objects, the invention provides duplex electrographic imaging method and apparatus utilizing a simultaneous transfixing of toner images to opposite sides of a receptor medium using high pressure alone. The apparatus of the preferred embodiment incorporates a hard, very smooth imaging roller and a moderately smooth, compliant transfer roller. A first toner image is transferred from the image roller to the transfer roller, and thereafter to a receptor sheet or web which passes between the two. Prior to the latter transfer, a second toner image is formed on the image roller, so that the two toner images are simultaneously transferred and fused to opposite sides of the receptor sheet.

In accordance with one aspect of the invention, the image roller includes a hard, smooth surface layer, preferably a dielectric layer having a resistivity in excess of $10^{12}$ ohm centimeters. In the preferred embodiment, the dielectric surface layer has a modulus of elasticity in compression on the order of $10^7$ PSI, and a smoothness in excess of 20 microinch rms. These surface characteristics yield excellent toner release properties, thereby enabling essentially complete toner transfer both of the first image to the transfer roller, and of the second image to the receptor medium.

In accordance with another aspect of the invention, the transfer roller includes a surface layer which is relatively compliant as compared with that of the image roller. In the preferred embodiment, the transfer roller surface is composed of an engineering thermoplastic or thermoset material, which is characterized by a modulus of elasticity in compression on the order of 100,000–700,000 PSI. It has been determined that a particularly suitable subclass of transfer roller material is characterized by a relatively low coefficient of friction. Advantageous materials of this description include various homopolymers and copolymers of acetal resins. These transfer roller materials yield favorably high toner transfer efficiencies both from the image roller to the transfer roller, and from the latter to the receptor medium.

The two rollers are advantageously rotated at essentially identical surface velocities. In a particular embodiment of the invention, the rollers are skewed to provide enhanced toner transfer efficiency from the image roller to both the transfer roller and the receptor sheet.

In accordance with another aspect of the invention, the duplex imaging apparatus is suitably employed in high speed electrographic printers and copiers. In either case, the apparatus should be designed to provide a mirror reversal of the first toner image when it is formed on the imaging roller. The duplex imaging apparatus of the invention provides high quality images at high speeds.

BRIEF DESCRIPTION OF THE DRAWINGS

The above and additional aspects and embodiments of the invention are illustrated by reference to the detailed description which follows, taken in conjunction with the drawings in which.

DETAILED DESCRIPTION

Figure 1:
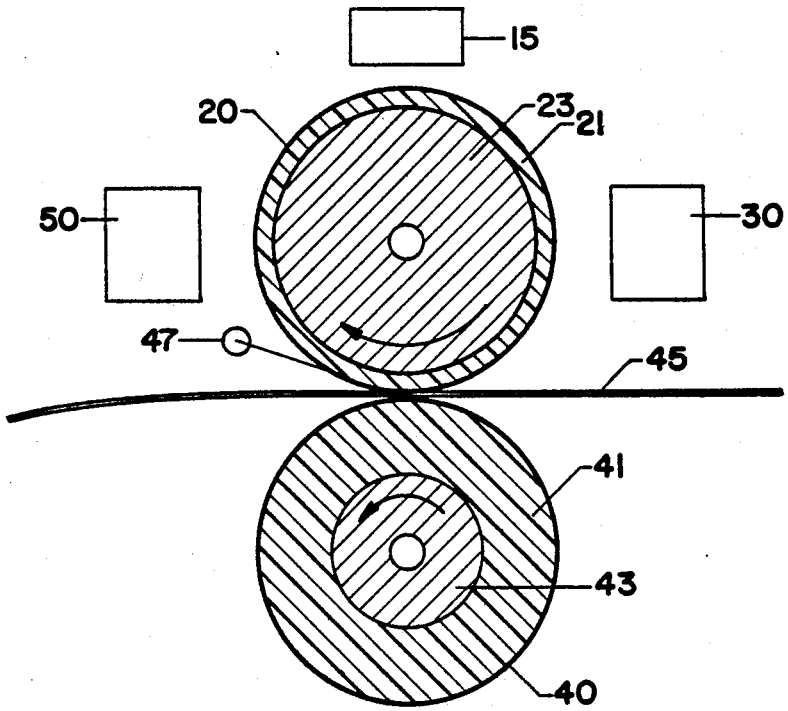
FIG. 1 is a schematic view of duplex electrographic imaging apparatus with a receptor sheet inserted between the rollers.

Reference should now be had to FIGS. 1 through 5 for a detailed description of the duplex imaging technique of the invention. This technique is advantageously employed in connection with electrostatic printing and copying apparatus of the type shown at 10 in FIG. 1. Apparatus of this description is disclosed in commonly assigned U.S. Pat. Nos. 4,195,927 and 4,267,556. This apparatus includes an image roller 20, a transfer roller 40, and various peripheral devices disposed adjacent the image roller. The peripheral devices include an image generating station 15, a toning device 30, and residual image erase station 50. Electrostatic printers and copiers in accordance with the invention differ in the nature of image generating stage 15, but may employ identical apparatus subsequent to the formation of the latent electrostatic image.

As shown in FIG. 1, the imaging roller 20 advantageously includes a conducting core 23 and a dielectric surface layer 21. The dielectric layer 21 should have sufficiently high resistance to support a latent electrostatic image during the period between formation of the latent image and toning. Consequently, the resistivity of the layer 21 should be in excess of $10^{12}$ ohm centimeters. The preferred thickness of the insulating layer 21 is between 0.025 and 0.075 mm. The surface of the layer 21 desirably is highly resistant to abrasion and relatively smooth, with a finish that is preferably better than 20 microinch rms, most preferably better than 10 microinch, in order to provide for substantially complete transfer of toner to the receptor sheet 45 as well as to transfer roller 40. The dielectric layer 21 additionally should have a high modulus of elasticity in compression, typically in the order of $10^7$ PSI, so that it is not distorted significantly by high pressures in the transfer nip.

A number of organic and inorganic dielectric materials are suitable for the layer 21. Glass enamel, for example, may be deposited and fused to the surface of a steel or aluminum cylinder. Flame or plasma sprayed high density aluminum oxide may also be employed in place of glass enamel. Plastics materials, such as polyamides, polyimides and other tough thermoplastic or thermosetting resins are also suitable. However, the preferred dielectric coating is anodized aluminum oxide impregnated with an insulating material as disclosed in copending applications Ser. No. 294,074 filed Aug. 18, 1981, and Ser. No. 346,349, filed Feb. 5, 1982.

The latent electrostatic image on dielectric surface 21 is transformed to a visible image at toning station 30. While any conventional electrostatic toner may be used, the preferred toner is of the single component conducting magnetic type described by J. C. Wilson, U.S. Pat. No. 2,846,333, issued Aug. 5, 1958. This toner has the advantage of simplicity and cleanliness.

Figure 2:
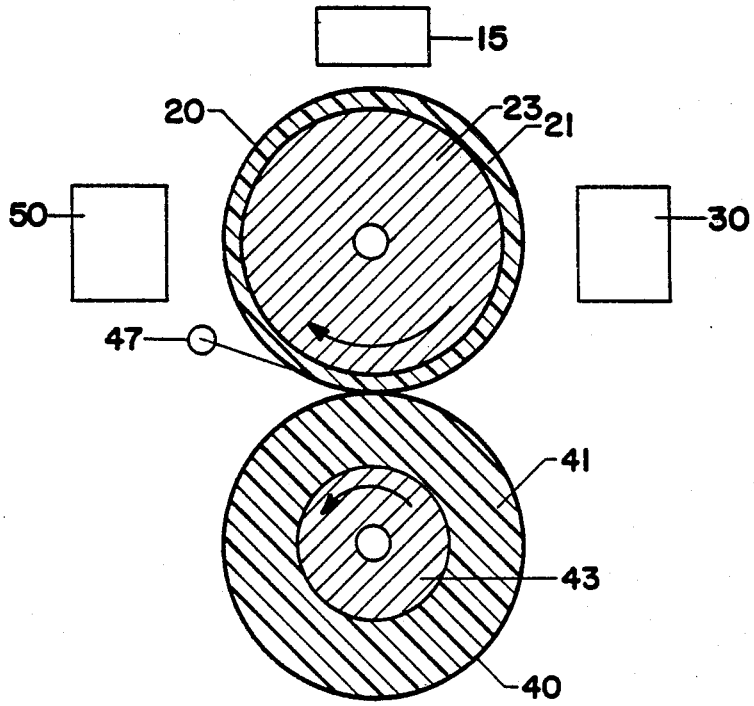
FIG. 2 is a schematic view of the duplex imaging apparatus of FIG. 1, with the rollers in direct contact.

As shown in FIG. 1, the toned electrostatic image on image roller 20 is transferred to a receptor sheet 45 by high pressure applied between rollers 20 and 40. In the duplex imaging method of the invention, receptor sheet 45 is inserted between rollers 20 and 40 only during the second of two toner image transfers. As illustrated in FIG. 2, an initial transfer takes place directly from image roller 20 to transfer roller 40, with no receptor inserted between the two. Such transfer should be substantially complete, leaving a toner image on transfer roller 40 which is the mirror image of that previously formed on image roller 20.

Transfer roller 40 serves a number of functions in the duplex imaging process. Initially, it receives and carries the toner image transferred from roller 20. During the second transfer, it should effect a substantially complete transfer of toner to receptor sheet 45. In order to achieve substantially complete toner transfer between rollers 20 and 40, the latter should have a somewhat rougher finish than the former. On the other hand, it is desirable that roller 40 have a moderately smooth surface to provide favorable toner release characteristics to receptor media 45 (typically plain paper). Illustratively, roller 40 should have a smoothness better than 30 microinch rms, but several times rougher than that of roller 20.

In the preferred embodiment, the duplex transfer to receptor sheet 45 is accomplished simultaneously with a fusing of the toner images due to high pressure applied between the two rollers. Such pressure may be provided by a pressure drum 40 comprising a metallic core 43 having an outer covering of engineering plastic 41. The pressure required for good fusing to plain paper is governed by such factors as, for example, roller diameter, the toner employed, and the presence of any coating on the surface of the paper. Typical pressures run from 18 to 125 kg per linear cm of contact. One requirement of plastic cover 41 is to absorb any high stresses introduced into the nip in the case of a paper jam or wrinkle. By absorbing stress in the plastic layer, the dielectric coated roller will not be damaged during accidental paper wrinkles or jams. This material should therefore have high impact resistance under stresses of this nature. The covering typically has a wall thickness in the range of 3 to 12.5 mm. Suitable engineering plastics may be chosen from nylons, polyesters, polyvinyl chloride, and polycarbonates; as explained below, however, preferred materials are chosen from the acetal resins.

It has been observed that the quality of the toner transfer from transfer roller 40 to receptor sheet 45 is improved if the roller surface 41 has a relatively low coefficient of friction. Particularly suitable engineering plastics having this characteristic are found in the acetal resins, i.e. homopolymers and copolymers of polyoxymethylene. Illustrative polymers of this type include a homopolymer of formaldehyde sold under the tradename DELRIN (DELRIN is a registered trademark of E. I. duPont de Nemours & Co., Wilmington, Del.); and a copolymer based on trioxane sold under the tradename CELCON (CELCON is a registered trademark of the Celanese Corporation, Chatham, N.J.). Of these, the former is preferred in that it has a higher modulus of elasticity and provides greater durability.

In a preferred embodiment of the invention, rollers 20 and 40 are disposed in a non-parallel axial orientation in order to enhance the toner transfers from roller 20 to roller 40 and receptor sheet 45. Apparatus and method for skewed roller transfixing are disclosed in commonly assigned U.S. application Ser. No. 180,218, filed Aug. 21, 1980. As disclosed in this co-pending application, the skewing of rollers 20 and 40 enhances toner transfer efficiency by inducing a surface motion differential or "slip" between rollers 20 and 40. Where image receptor preferentially adheres to the surface of transfer roller layer 41, the above slip will be matched by a slip between roller 20 and receptor sheet 45. In adapting this technique to the present invention, it is desirable to choose the roller materials to additionally provide a slip between receptor sheet 45 and transfer roller 40.

A scraper blade 47 may be provided adjacent the imaging roller, as shown in FIG. 1, to remove from the surface any residual paper dust, toner accidentally impacted on the surface, and airborne dust and dirt. Since substantially all of the toner image is transferred to roller 40 or receptor 45, the scraper blade is not essential, but is desirable in promoting reliable operation over an extended period. No scraper blade is needed adjacent transfer roller 40, in that minimal buildup of toner, dust particles, etc. will not significantly affect its performance characteristics.

Rollers 20 and 40 are advantageously rotated from a common drive source. Image roller 20, for example, may be directly driven at a given angular velocity, and transfer roller 40 frictionally driven by contact. Due to the high pressure with which the rollers are pressed together, they move at virtually the same linear surface velocity with or without a receptor sheet 45 inserted between them.

Figure 3A:
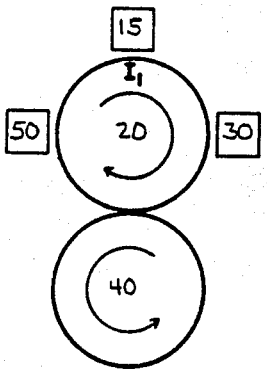
FIGS. 3A–3F are sequential schematic views of the apparatus of FIGS. 1 and 2, showing various stages of the duplex imaging process.
Figure 3B:
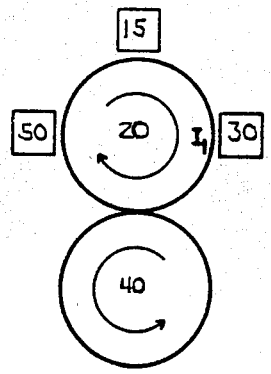
Figure 3C:
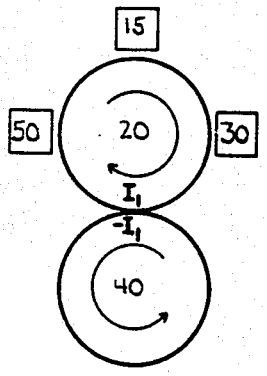
Figure 3D:
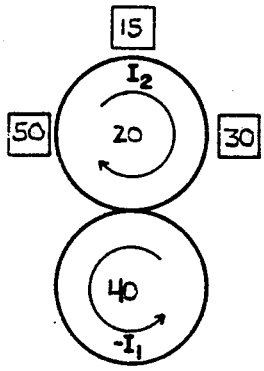
Figure 3E:
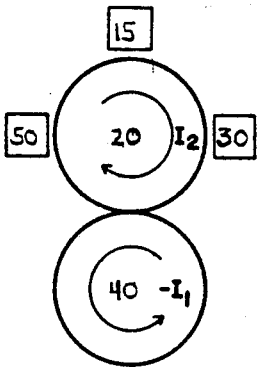
Figure 3F:
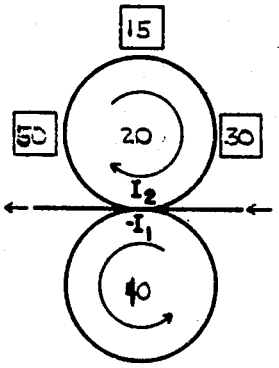

The various stages of the duplex imaging process are illustrated in the schematic views of FIGS. 3A through 3F. In FIG. 3A, a first latent electrostatic image $I_1$ is formed on image roller 20 at image generating station 15. Image $I_1$ is toned at toning station 30 (FIG. 3B), and rotated to a position of contact with transfer roller 40 to which it is pressure transferred (FIG. 3C). The first image, now inverted ($-I_1$), continues to rotate on transfer roller 40 while a second latent electrostatic image $I_2$ is formed on image roller 20 (FIG. 3D). During this period, any residual electrostatic image I, on image roller 20 may be erased by charge neutralizing device 50. The second image $I_2$ is toned (FIG. 3E), and the two toner images are rotated to the nip, where they are pressure transferred and fused to receptor sheet 45 (FIG. 3F). If it is desired to match the positions of images $-I_1$ and $I_2$ on receptor sheet 45, it is necessary to time the formation of image $I_2$ so that the circumferential distance from the nip on roller 20 of leading edge of image $I_2$ equals the circumferential distance from the nip on roller 40 of the leading edge of image $-I_1$. The time interval between successive image formations should equal the period of rotation of roller 40.

Figure 4A:
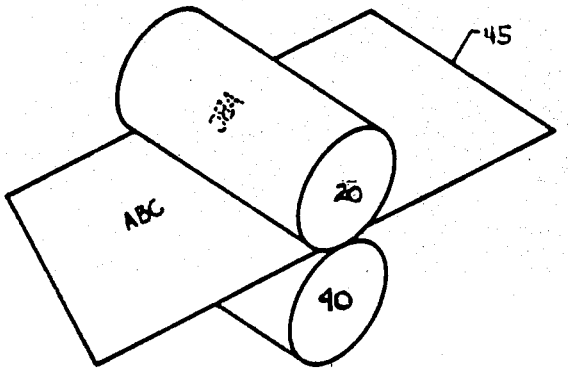
FIGS. 4A–D are sequential schematic views of the apparatus of FIGS. 1 and 2, bearing a series of latent electrostatic images and toner images.
Figure 4B:
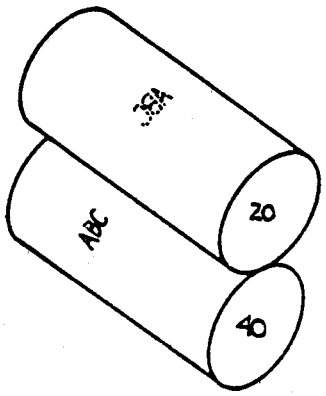
Figure 4C:
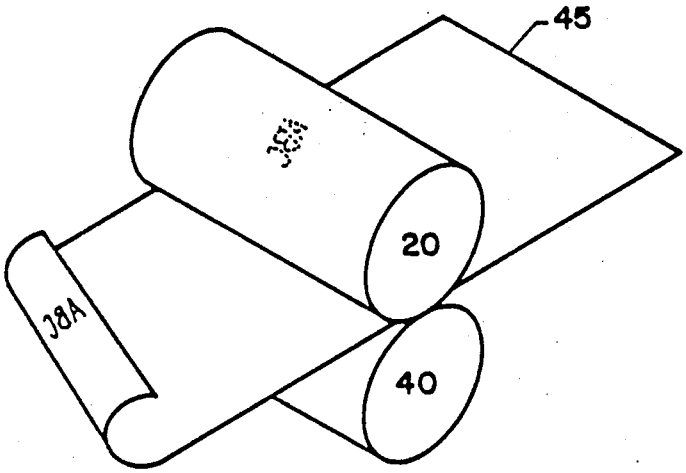
Figure 4D:
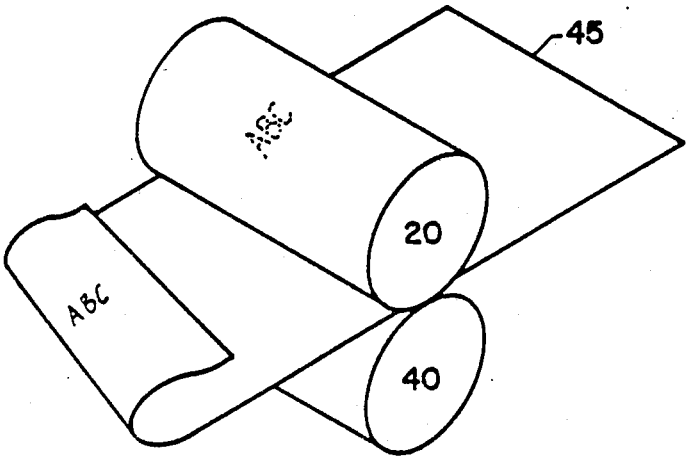

In order to counteract the mirror reversal of first image $I_1$ that results from the double transfer of the image, it is necessary to provide an inverted latent electrostatic image at image generating station 15. FIG. 4A shows the case of one-sided printing from the image roller 20. In order to transfer a row of toned characters onto receptor 45, image generating station 15 forms an inverted row of latent electrostatic characters along the circumference of roller 20. In FIG. 4B, the toned characters have been transferred to transfer roller 40. In FIG. 4C, the toned characters have been further transferred to the bottom side of receptor sheet 45. As a result of the double transfer, they are printed in an inverted orientation. Thus, as shown in FIG. 4D, it is necessary to reverse the orientation (i.e. back to normal orientation) of the latent characters on roller 20 for transfer to the second side of receptor 45.

In the case of electrophotographic apparatus, image generating station 15 may comprise a photoconductor member on which a latent electrostatic image is formed corresponding to a scanned optical image, with a transfer of the latent image to image roller 20 by TESI. Apparatus of this type is disclosed in commonly assigned U.S. Pat. No. 4,195,925. As will be apparent to those skilled in the art the scanning optics may be simply modified to provide an inversion of alternate images.

In the case of electrographic printing apparatus, the latent electrostatic image on image roller 20 is formed by ion generating means in response to a signal indicative of the desired image, as disclosed in commonly assigned U.S. Pat. No. 4,267,556. Commonly assigned U.S. Pat. No. 4,155,093 discloses method and apparatus for generating charged particles involving two electrodes separated by a solid dielectric, with a time varying potential between the electrodes causing an electrical discharge in an air region adjacent one of the electrodes. Ions may be extracted from the air region by a direct current potential to form a latent electrostatic image on image roller 20.

Figure 5:
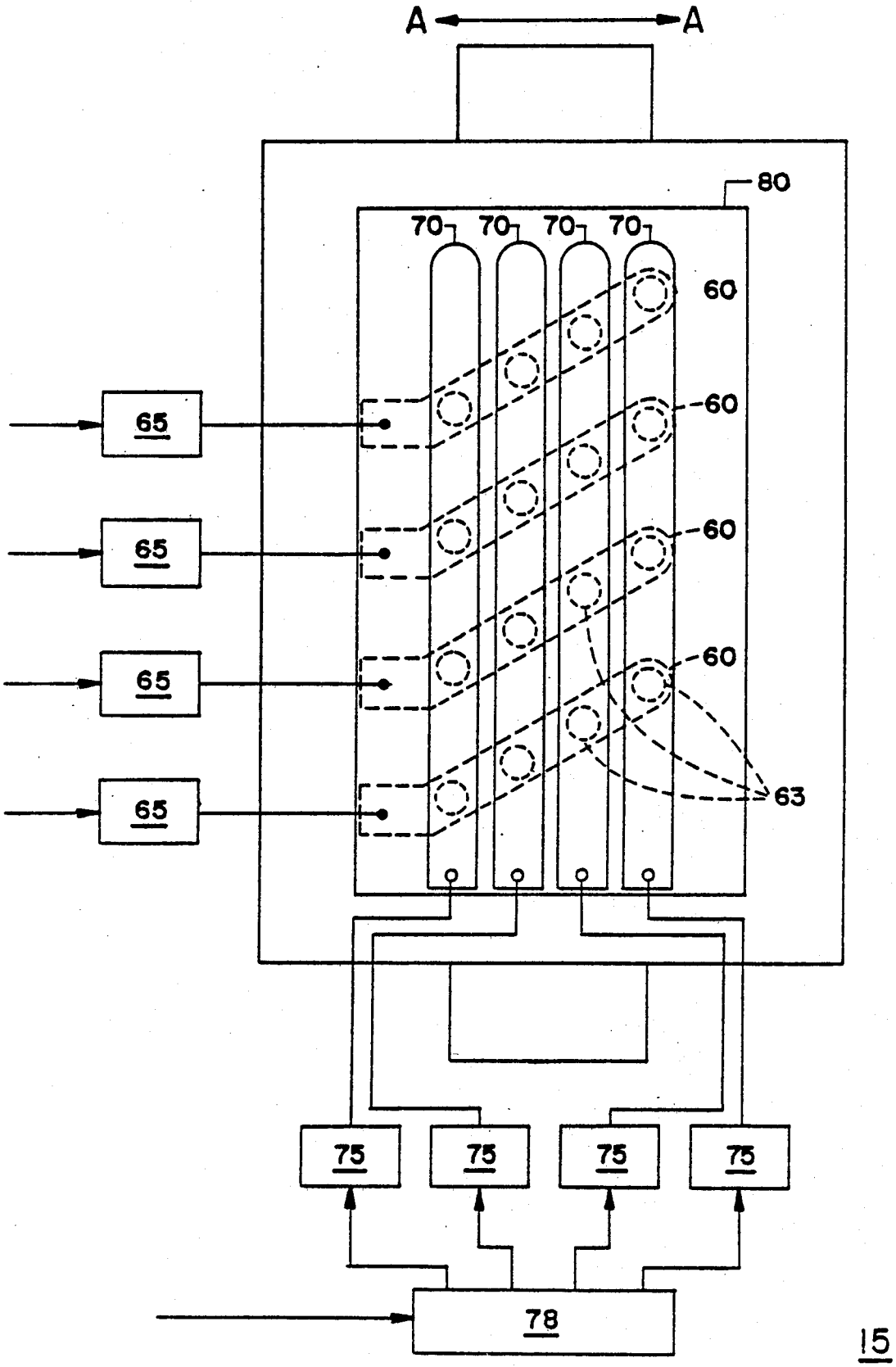
FIG. 5 is a plan view of a latent electrostatic image generating device for the apparatus of FIGS. 1 and 2, in accordance with a preferred embodiment of the invention.

FIG. 5 shows in a plan view a multiplexed ion generator of the above type. The ion generator 15 includes a series of finger electrodes 60 and a crossing series of selector bars 70 with an intervening dielectric layer 80. Ions are generated at apertures 63 in the finger electrodes 60 at matrix crossover points. Ions can only be extracted from an aperture 63 when its selector bar is energized by a high voltage alternating potential supplied by one of gated oscillators 75, and simultaneously its finger electrode is energized by a direct current potential supplied by one of pulse generators 65. The timing of gated oscillators is advantageously controlled by a counter 78.

If axis A—A of the ion generator is oriented along the circumference of upper roller 20, one may invert the latent electrostatic image as required by the invention by reversing the order of signals to selector bars 70 from gated oscillators 75. This may be done by reversing the sequence of actuating signals from counter 78.

The invention is further illustrated with reference to the following non-limiting examples.

EXAMPLE 1

A specific operative example of a duplex electrographic imaging system was constructed as follows: The cylindrical conducting core 23 of the image roller 20 was machined from 7075-T6 aluminum to a diameter of 76 mm. The length of this cylindrical core, excluding machined journals, was 230 mm. The journals were masked, and the aluminum anodized by use of the Sanford process (see S. Wernick and R. Pineer, "The Surface Treatment and Finishing of Aluminum and Its Alloys", Robert Draper Ltd., 4th Edition 1971/72, Vol. 2, Page 567). The finished aluminum oxide layer was 60 micrometers (um) in thickness. The conducting core 23 was next heated in a vacuum oven at a temperature of 150° C. for twelve hours and then permitted to cool to 50° C. After removal from the oven, the cylindrical core was brush-coated with a low viscosity epoxy (Hysol Co. R9-2039 resin-100 parts by weight; H2-3404 hardener 11 parts by weight). The epoxy was allowed to impregnate the pores, and the excess on the surface then wiped off. The epoxy was cured at 78° C. for eighteen hours in a vacuum oven, thereby forming the dielectric surface layer 21. The surface 21 of the dielectric cylinder 20 was then finished to 7 microinch rms using 600 grit silicon carbide paper.

The transfer roller 40 consisted of a solid machined 50 mm diameter core 43 over which was pressfitted a 50 mm inner diameter, 62.5 mm outer diameter sleeve 41, fabricated of DELRIN acetal resin from E. I. duPont de Nemours & Co., Wilmington, Del. The roller surface was machined to a smoothness of 20 microinch rms.

The image roller 20 was gear driven from an AC motor to provide a surface speed of twenty cms per second. The transfer roller 40 was mounted on pivotted and spring-loaded side frames, causing it to press against the dielectric cylinder 20 with a pressure of 55 kg per linear cm of contact.

The single component latent image toning apparatus was essentially identical to that employed in the Develop KG Dr. Eisbein & Co. (Stuttgart) No. 444 copier.

A charging head for generating latent electrostatic dot matrix character images in accordance with FIG. 5 was provided as follows: A stainless steel foil 0.025 mm in thickness was laminated on both sides of a 1 mil thick Muscovite mica film. The stainless foil was coated with photoresist and etched with a pattern similar to that shown in FIG. 5, with holes or apertures in the fingers approximately 0.15 mm in diameter. Charging occurred only when there was simultaneously a potential of negative 400 volts on a selected finger electrode and an alternating potential of 2 kilovolts peak to peak at a frequency of 500 kilohertz supplied between finger 60 and the selector bar 70. A spacing of 0.2 mm was maintained between the charging head assembly 15 and the dielectric surface of the image roller 20. The duration of the print pulse was 20 microseconds. Under these conditions, it was found that a latent electrostatic image of approximately 300 volts was produced on the dielectric surface 21.

EXAMPLE 2

The electrographic imaging system of Example 1 was modified as follows. The transfer roller 40 was fabricated of an acetal copolymer sold under the trade name CELCON by Celanese Corporation, Chatham, N.J.

EXAMPLE 3

The electrographic imaging system of Example 1 was modified as follows. The rollers 20 and 40 were disposed at an 0.9° skew by offsetting the roller 40 at the bearing retainer in its side frames. This resulted in a pronounced sidewise "slip" between the upper surface of a through-fed sheet and the dielectric surface of image roller 20. There was also a slight slip between the lower paper surface and the surface of transfer roller 41.

EXAMPLE 4

The electrographic imaging apparatus of Example 2 was modified in accordance with Example 3 to provide skewed roller duplex imaging apparatus.

EXAMPLE 5

The electrographic imaging system of the above examples were applied to duplex imaging as follows. A first latent electrostatic image was formed by matrix print head 15 and transferred to the dielectric surface 21 of roller 20. The latent image was toned at station 30 and transferred to the surface 41 of transfer roller 40. The toner employed was Hunt 1186 of the Phillip A. Hunt Chemical Corporation, Palisades Park, N.J. A second latent electrostatic image was formed on dielectric cylinder 20, approximately 1 second after the formation of the first image, with a reversed sequence of actuating signals to selector bars 70. The second latent image was toned, and the two toner images were simultaneously transferred to a sheet of OCR Imagetroll paper, manufactured by S.D. Warren, which was fed between the two rollers at the appropriate time. Toner transfer from the upper roller was tested by running a test pattern for thirty minutes and collecting and weighing the toner scrapings. Transfer from the lower roller to paper was tested by applying an adhesive tape to the roller surface following transfer. Fusing quality was tested using a dry rub technique by abrading the image-bearing paper with Shur-Wipe tissues for ten strokes, weighted at 918 grams for ten strokes.

The duplex imaging systems of the above examples all provided excellent toner transfer and image permanence with some improvement being noted in the skewed roller apparatus.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. A method of duplex imaging which comprises forming a first toner image on the surface of an image roller, said image surface having a smoothness in excess of 20 microinch rms and a modulus of elasticity in compression of at least $10^7$ PSI;

transferring said first toner image to the surface of a transfer roller in rolling contact with said image roller under a compressive load, said transfer roller having a surface layer of a material selected from the group consisting of engineering thermoplastic and engineering thermoset materials;

creating a second toner image on the surface of the image roller;

passing an image receptor sheet between said image roller and said transfer roller; and transferring said first toner image from said transfer roller to one side of said image transfer sheet and simultaneously transferring said second toner image from said image roller to an opposite side of said image receptor sheet, wherein the rollers are pressed together sufficiently to fuse the toner images to said image receptor sheet at ambient temperatures.

2. The method of claim 1 wherein the image roller has a dielectric surface layer, and wherein the steps of forming the first and second toner images each comprise forming a latent electrostatic image on said dielectric surface layer, and applying toner to said dielectric surface layer to form a toner image as a visible counterpart to the latent electrostatic image.

3. The method of claim 1 wherein the image receptor sheet passes between the image roller and transfer roller with a surface speed differential with respect to the roller surfaces, thereby to enhance transfer and fusing of the toner images thereto.

4. The method of claim 2 wherein the image roller is comprised of aluminum anodized to form an oxide surface layer, which is impregnated with a dielectric material and polished to a smoothness in excess of 20 microinch rms.

5. The method of claim 1, for electrographic printing, wherein the steps of creating the first and second latent electrostatic images on the image roller are effected by a matrix print head comprising a multiplicity of row electrodes and column electrodes forming cross points in a matrix array, such that a matrix point latent electrostatic image is created for a given cross point location in response to actuating signals to the row and column electrodes forming the given cross point.

6. The method of claim 1, further comprising the step of skewing the image and transfer rollers sufficiently to ensure substantially complete toner transfer from the image roller to the image receptor sheet.

7. The method of claim 1 wherein the transfer roller is comprised of a material selected from the group consisting of copolymers and homopolymers of polyoxymethylene.

8. The method of claim 1 wherein the surface layer of the transfer roller is comprised of a material of low frictional coefficient.

9. The method of claim 1 wherein the toner comprises a hydrophobic, single component powder.

10. The method of claim 1 wherein the dielectric surface of the image roller comprises a hard, abrasion resistant material.

11. A method of duplex imaging which comprises forming a first toner image on the surface of an image roller comprised of aluminum anodized to form an oxide surface layer, which is impregnated with a dielectric material and polished to a smoothness in excess of 20 microinch rms;

transferring said first toner image to the surface of a transfer roller in rolling contact with said image roller under a compressive load, said transfer roller having a surface layer of a material selected from the group consisting of copolymers and homopolymers of polyoxymethylene, polyesters, polyvinylchloride, and polycarbonates;

forming a second toner image on the surface of said image roller;

passing an image receptor sheet between said image roller and said transfer roller; and transferring said first toner image from said transfer roller to one side of said image receptor sheet and simultaneously transferring said second toner image from said image roller to an opposite side of said image receptor sheet, wherein the rollers are pressed together sufficiently to fuse the toner images to said image receptor sheet at ambient temperatures.

12. The method of claim 11 wherein the image roller has a dielectric surface layer, and wherein the steps of forming the first and second toner images each comprise forming a latent electrostatic image on said dielectric surface layer, and applying toner to said dielectric surface layer to form a toner image as a visible counterpart to the latent electrostatic image.

13. The method of claim 11, further comprising the step of skewing the image and transfer rollers sufficiently to ensure substantially complete toner transfer from the image roller to the image receptor.

14. The method of claim 11 wherein the image receptor sheet passes between the image roller and transfer roller with a surface speed differential with respect to the roller surfaces, thereby to enhance transfer and fusing of the toner images thereto.

15. The method of claim 11 wherein the toner comprises a hydrophobic, single component powder.

16. A method of duplex imaging which comprises creating a first toner image on the surface of an image roller, said image surface having a smoothness in excess of 20 microinch rms and a modulus of elasticity in compression of at least $10^7$ PSI;

transferring said first toner image to the surface of a transfer roller in rolling contact with said image roller under a compressive load, said transfer roller having a surface layer of an engineering thermoplastic or thermoset material;

creating a second toner image on the surface of the image roller;

passing an image receptor sheet between said image roller and said transfer roller; and transferring said first toner image from said transfer roller to one side of said image transfer sheet and simultaneously transferring said second toner image from said image roller to an opposite side of said image receptor sheet, wherein the image roller and transfer roller are disposed at an axial skew, and the rollers are pressed together sufficiently to fuse the toner images to said image receptor sheet at ambient temperatures.

17. The method of claim 16 wherein the image roller has a dielectric surface layer, and wherein the steps of forming the first and second toner images each comprise forming a latent electrostatic image on said dielectric surface layer, and applying toner to said dielectric surface layer to form a toner image as a visible counterpart to the latent electrostatic image.

18. The method of claim 16 wherein the toner comprises a hydrophobic, single component powder.

* * * * *